United States Patent [19]

Reith

[11] Patent Number: 4,531,449

[45] Date of Patent: Jul. 30, 1985

[54] ARRANGEMENT FOR CONTROLLING A HYDRAULIC MOTOR

[75] Inventor: Werner Reith, Karlstadt, Fed. Rep. of Germany

[73] Assignee: Mannesmann Rexroth GmbH, Lohr, Fed. Rep. of Germany

[21] Appl. No.: 431,572

[22] Filed: Sep. 30, 1982

[30] Foreign Application Priority Data

Oct. 10, 1981 [DE] Fed. Rep. of Germany ..... 3140266

[51] Int. Cl.[3] ..... F15B 13/042

[52] U.S. Cl. ..... 91/420; 91/461

[58] Field of Search ..... 91/420, 461; 137/106

[56] References Cited

U.S. PATENT DOCUMENTS 4,232,588 11/1980 Ziplies et al. ..... 91/461

4,244,275 1/1981 Smilges ..... 91/420

*Primary Examiner*—Robert E. Garrett

*Assistant Examiner*—John M. Husar

*Attorney, Agent, or Firm*—Michael J. Striker

[57] ABSTRACT

An arrangement for controlling a hydraulic motor having supply and discharge sides, has a throttling directional valve having supply and discharge sides and a port, a speed lowering brake valve controlling the discharge side of the hydraulic motor and having a control piston with a control side and a port connected with said port of said directional valve, a control valve arrangement between the control side of the control piston and the supply side of the hydraulic motor and having end sides with end side ports, the control valve having a control slider which selectively connects the control side of the control piston with the supply side of the hydraulic motor and disconnects the control side of the control piston from the latter, is constantly connected at the end side ports with the discharge side of the hydraulic motor prior or after the directional valve and connects the discharge side of the hydraulic motor after the directional valve with the control side of the control piston or disconnect the discharge side of the hydraulic motor from the latter, the control valve also having a control spring acting upon the control slider in a direction corresponding to a direction in which a pressure medium acts upon the discharge side of the hydraulic motor after the directional valve.

7 Claims, 3 Drawing Figures

ARRANGEMENT FOR CONTROLLING A HYDRAULIC MOTOR

BACKGROUND OF THE INVENTION

The present invention relates to an arrangement for controlling a hydraulic motor. More particularly it relates to an arrangement for controlling a hydraulic motor with a throttling directional valve, a speed lowering brake valve controlling a discharge side of the hydraulic motor and having a control piston with a control side and a port connected with a port of a directional valve, and a control valve arranged between the control side of the control piston and a supply side of the hydraulic motor.

Arrangements of the above-mentioned general type are known in the art. In a known arrangement, a lowering speed brake valve is directly controlled by a pump pressure which is adjusted between a pump and the hydraulic motor. With varying pump pressure, the control piston of the speed lowering brake valve correspondingly acts upon these variations and the valve member of the speed lowering brake valve correspondingly controls the variations. Thereby different pressure takes place between the directional valve port connected with the speed lowering brake valve and the direction valve port connected with the supply container. As a result of this, with the same position of the valve member of the directional valve, different pressure medium streams flow from the hydraulic motor to the supply container (German magazine "Fluid", February 1979, pages 31–33).

For controlling the hydraulic motor independently from its loading, it is known to connect a pressure regulating valve between the control side of the speed lowering brake valve and the hydraulic motor so that the control conduit of the pressure regulating valve is connected with a conduit connected with the speed lowering brake valve, and a chamber accommodating a pressure spring is connected with the brake valve port connected with the directional valve. Thereby the pressure at the brake valve port connected with the direction valve is held constant, whereby the directional valve port connected with the speed lowering brake valve and the supply container is held constant. Pressure variations at the pump or consumer side no longer act upon the flowing back liquid quantity. The speed lowering brake valve acts as a pressure manometer, whereby its braking function is not affected. However, the constant pressure difference at the directional valve acts at the side of the high pressure in addition to the differently applied spring force of the pressure spring during the displacement of the control piston and the different forces due to the flow at the control piston acted upon with constant control pressure. Since the control piston is always located in condition of force equilibrium when the sum of the three above-mentioned forces is equal to the force from the constant control pressure, the equilibrium is established with a very great force from the flow, before the high pressure of the pressure differential maintains constant at a directional valve obtains its nominal value (German Auslegeschrift No. 2,911,891).

SUMMARY OF THE INVENTION

Accordingly, it is an object of the present invention to provide an arrangement for controlling a hydraulic motor, which avoids the disadvantages of the prior art.

More particularly, it is an object of the present invention to provide an arrangement for controlling a hydraulic motor in which different spring and flow forces are equalized so that the desired pressure difference at the directional valve is attained.

In keeping with these objects and with others which will become apparent hereinafter, one feature of the present invention resides, briefly stated, in an arrangement for controlling a hydraulic motor, in which a control valve arranged between a control side of a control piston of a speed lowering brake valve and a supply side of the hydraulic motor has a control slider which selectively connects the control side of the control piston with the supply side of the hydraulic motor and disconnects said control side of said control piston from the latter and is constantly connected at its end side ports with the discharge side of the hydraulic motor prior or after the directional valve, and connects the discharge side of the hydraulic motor after the directional valve with the control side of the control piston or disconnects the discharge side of the hydraulic motor from the latter, and the control valve also has a control spring acting upon the control slider in a direction corresponding to a direction in which a pressure medium acts upon the discharge side of the hydraulic motor after the directional valve.

The control slider of the control valve is controlled in dependence upon the pressure differential which is formed at its ports for the pressure medium flowing from the hydraulic motor and with the supply container. The pressure increasing with the pressure medium flow in the discharge conduit of the hydraulic motor displaces the control slider against the force of the spring acting thereupon, whereby the connection between the pressure side of the pump and the control side of the control piston correspondingly throttles and blocks the throughflow, as soon as the desired pressure differential is attained at the above-mentioned ports of the regulating valve. When the pressure increases after the speed lowering brake valve further, the control side of the control piston is connected with the supply container, whereby the control pressure acting upon the control piston is formed. When the pressure after the speed lowering brake valve reduces, the pressure side of the pump is again connected with the control side of the control piston. The variations of the pressure after the speed lowering brake valve from its nominal value depend only upon the hysteresis of the control slider, its overlapping and the rigidity of the control spring.

Another feature of the present invention is that there is a throttling location between the discharge side of the hydraulic motor prior to the directional valve and the end side port connected with the directional valve.

Still another feature of the present invention is that there are two side speed lowering brake valves controlling the supply side of the hydraulic motor and having control pistons with control sides, wherein the control sides of both brake valves are connected with one another.

A further feature of the present invention is that the arrangement has two changeover valves provided in a respective one of conduits connected with the side of the hydraulic motor, prior to a respective one of the speed lowering brake valve, wherein one of the changeover valves connects one end side of the control slider with the discharge side of the hydraulic motor, whereas the other changeover valve connects the control side of the control piston selectively with the supply side of the hydraulic motor.

Still a further feature of the present invention is that the arrangement has two such control valves with a plurality of further ports in addition to the end side ports, wherein the further port of the control valve at a side facing away from the springs are connected with one another, and each of the end side ports of the control valves at a side facing away from the springs is connected with a respective port of the directional valve connected with the hydraulic motor.

Finally, still a further feature of the present invention is that the discharge side of the hydraulic motor communicates after the directional valve with the control side of the control piston only then and during separation of the supply side of the hydraulic motor prior to the control side of the control piston.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENT

Figure 1:
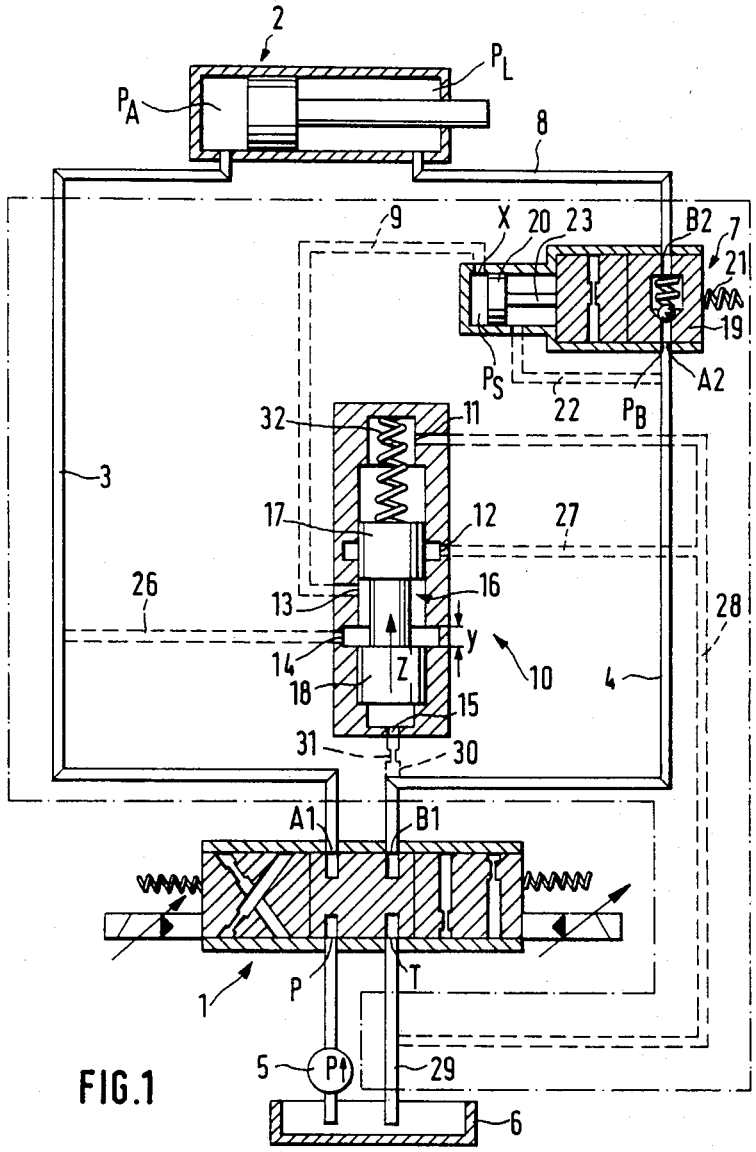
FIG. 1 is a view schematically showing an arrangement for controlling a hydraulic motor in accordance with the present invention.

The arrangement in accordance with the present invention has a throttling directional valve 1 which is formed as an electrohydraulic servo valve, also identified as a proportional valve. The directional valve 1 has two ports or connecting points A1 and B1 connected with conduits 3 and 4, respectively. The above-mentioned ports are connected via the above-mentioned conduits with a hydraulic motor 2 which is formed as a double-acting cylinder-and-piston unit. A port P of the directional valve 1 is connected with a pump 5, and another port T is connected with a supply container 6.

The directional valve 1 has a slider which is controlled by an electromagnet. The respective position of the armature of this magnet depends upon the respective used voltage. The slider of the directional valve does not have, therefore, three determined control position, but instead has always alternating control positions. The throughflow through the directional valve is throttled as shown.

The conduit 3 leads directly to the hydraulic motor 2, whereas the conduit 4 leads to a port A2 of a lowering speed brake valve 7 whose port B2 is connected via a conduit 8 with the hydraulic motor 2. The lowering speed brake valve 7 has a control port X which is connected via a conduit 9 with a control valve 10. The control valve 10 has ports 11–15 and a control slider 16 with two piston-shaped control parts 17 and 18.

The lowering brake valve 7 has a main valve member 19 and a control piston 20 which actuates the latter. The control piston 20 is acted upon at its opposite sides from conduits 9 and 22 via ports X and A2. A pressure spring 21 between the valve member 19 and the housing of the lowering brake valve 7 is prestressed and tends to hold the valve member 19 on the control piston 20. The valve member 19 and the control piston 20 can also be fixedly connected with one another. The control piston 20 is connected with a piston rod 23 at its side facing toward the valve member 19.

The port 14 of the control valve 10 is connected via a conduit 26 with the conduit 3. The conduit 9 connected with the port X is connected with the port 13 of the control valve 10 which opens in an inoperative position of the control slider 16 between both control pistons 17 and 18. In the position of the control slider 16 shown in FIG. 1, the ports 13 and 14 are connected with one another. The port 12 which in the inoperative position of the control slider 16 is closed by the control piston 17, is connected via a conduit 27 with a conduit 28. The latter connects the port 11 (connected with the end side of the control piston 17 of the control slider 16) with a conduit 29 leading from the port T of the directional valve 1 to the supply container 6. The port 15 connected with the end side of the control piston 18 of the control slider 16 is connected via a conduit 30 with the port B1 of the directional valve 1. An advantageously adjustable throttling point 31 is provided in the conduit 30.

When the control member of the directional valve 1 is displaced from its central position to the left, the ports P and A1 at one side and the ports B1 and T at the other side are respectively connected with one another in a throttling manner. A pressure $P_A$ forms in the conduit 3 and tends to displace the piston of the cylinder-and-piston unit 2 to the right. Thereby a higher pressure $P_L$ is formed at its right side in correspondence with the cross-section of the piston rod, as long as the main valve member 19 of the lowering brake valve 7 is located in its blocking position. With increasing pressure $P_A$, the pressure $P_S$ in the port X of the lowering brake valve 7 increases. The lowering speed brake valve 7 is connected via the conduits 26 and 9, the ports 13 and 14, and the intermediate chamber between the control pistons 17 and 18 of the control slider 16 with the conduit 3. With increasing control pressure $P_S$ the main valve member 19 opens and the pressure medium flows via the conduits 4 and 29 and the directional valve 1 into the supply container 6. The pressure medium flowing through the directional valve 1 produces at the throttling point between the ports $B_1$ and T a pressure differential. This pressure differential acts via the conduit 30 onto the lower end side of the control slider 16 and via the conduit 28 onto the upper end side of the control slider 16. The end sides of the control slider 16 have identical surfaces. Thus, the pressure in the port T of the directional valve acts at the side of the control valve 10, at which the control spring 32 is arranged, which tends to hold the control slider 16 in the position shown in FIG. 1.

The pressure $P_B$ in the port A2 of the lowering speed brake valve 7, which increases with the increasing pressure medium stream, displaces the control slider 16 against the force of the control spring 32 in direction of the arrow Z. The control spring 32 is so designed that after a predetermined stroke Y of the control slider 16 corresponding to the width of the port 14, the desired pressure differential between the ports $B_1$ and T in the directional valve is attained and the control piston 18 closes the port 14 of the control valve 10.

When the pressure $P_B$ in the port A2 of the lowering speed brake valve increases because of the increasing load pressure $P_L$, the control slider is displaced further in direction of the arrow Z until the control piston 17 controls the port 12. Thereby the port X is connected via the conduit 9, the ports 12 and 13 of the control valve 10, the intermediate chamber between the both control pistons 17 and 18 and the conduits 27 and 28 with the supply container 6. As a result of this, the control pressure $P_S$ decreases, whereby the control piston 20 and the main valve member 19 move in the closing direction and the pressure $P_B$ in the conduit 4 also decreases.

When the pressure $P_B$ in the conduit 4 decreases below the desired value, for example when the force of the flowing pressure medium moves the main valve member 19 in the closing direction, the control slider 16 runs back in direction to its initial position so far that the conduit 3 is again connected with the port X of the lowering speed brake valve. Thereby the main valve member 19 again moves in the opening direction until the pressure $P_B$ in the conduit 4 moves the control slider 16 so far that the port 14 is closed relative to the conduit 9. Because of the arrangement of the control valve 10, the pressure $P_B$ in the conduit 4 deviates from the nominal value only in dependence upon the hysteresis of the control slider, its simultaneous covering of the ports 12 and 14, and the rigidity of the control spring 32.

In the above-described embodiment the control piston 17 has a positive circuit overlapping. The desired control function can also be obtained with a control piston with a negative circuit overlapping, in other words short time throttling connection of the ports 12 and 14.

In the second and third embodiments parts which are similar to the parts of the first embodiment are identified with the same reference numerals, and different parts and different applications of the same parts are identified with the reference numerals having small letters.

Figure 2:
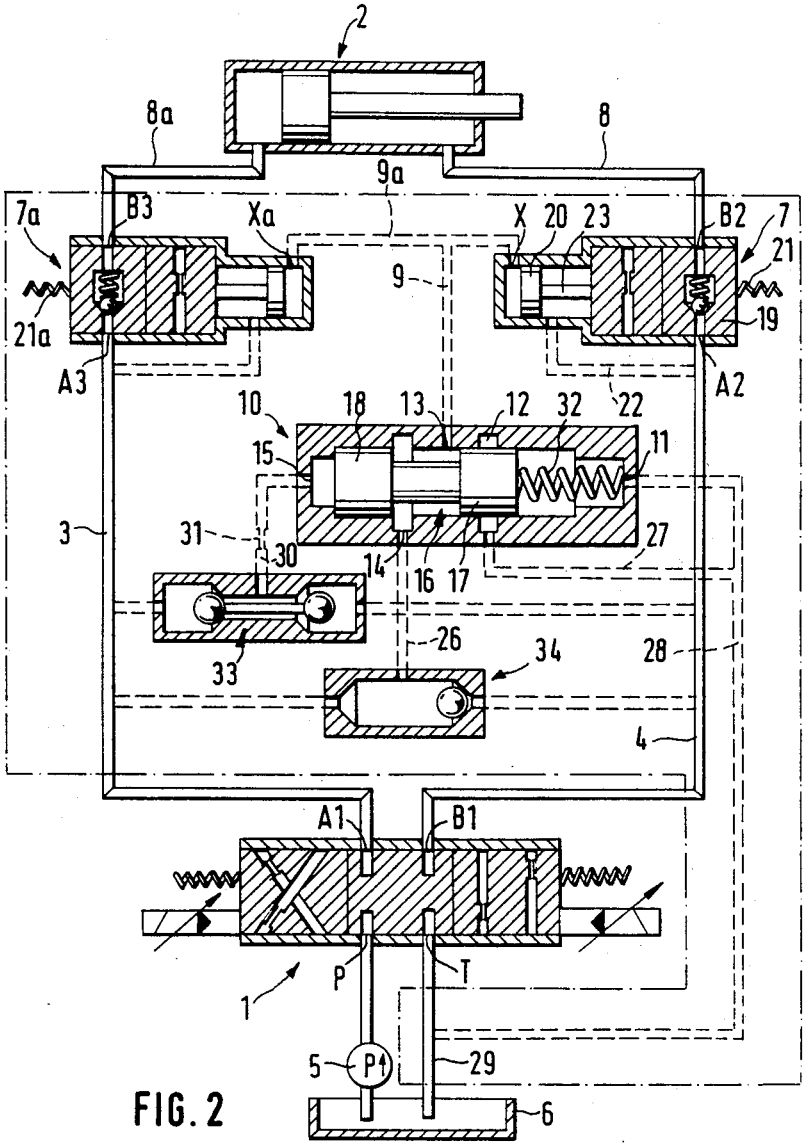
FIG. 2 is a view substantially corresponding to the view of FIG. 1 but showing the arrangement for controlling a hydraulic motor in accordance with another embodiment of the present invention.

In the second embodiment of the arrangement shown in FIG. 2, lowering speed brake valves 7 and **7*a* are arranged in both conduits 3 and 4 which lead from the direction of valve 1 to the hydraulic motor 2. The second lowering speed brake valve 7*a* has ports A3 and B3 as well as a control port Xa. The port B3 is connected via a conduit 8*a* with the hydraulic motor 2. Both ports X and Xa of the lowering speed brake valves 7 and 7*a* are connected with one another via conduit 9*a* and with the control valve 10 at the port 13 via the conduit 9. Two changeover valves 33 and 34 are arranged between both conduits 3 and 4. The changeover valve 33 is connected via the conduit 30 with the port 15 of the control valve 10, and the changeover valve 34 is connected via the conduit 26 with the port 14 of the control valve 10. When the changeover valve 34 connects the conduit 3 with the conduit 26, the changeover valve 33 connects the conduit 4 with the conduit 30** and vice versa.

The pressure medium flowing from the hydraulic motor 2 is held constant in both movement directions of its piston. The pressure medium flowing to the hydraulic motor 2 actuates the main valve member 19 of the lowering speed brake valve 7 or **7*a* like a check valve which is flown through in the opening direction. The changeover valves 33 and 34 are provided for using the same control valve 10 for both movement directions. When the control member of the changeover valves 33 and 34 assumes the position shown in FIG. 2, the valve member of the directional valve 1 is located in its left control position in which the port P is connected with the port A1 and the port B1 is connected with the port T. The pressure medium is thereby supplied from the pump 5 via the conduit 3 to the hydraulic motor 2 through the lowering speed brake valve 7*a* working as a check valve. The port 14 of the control valve 10 is connected as in the first embodiment with the conduit 3, and the port 15 of the control valve 10 is connected with the conduit 4**. The operation of this arrangement substantially corresponds to the operation of the arrangement in accordance with the first embodiment.

When the valve member of the directional valve 1 moves in its another control position in which the ports T and B1, as well as A1 and P are connected with one another, the pressure medium is supplied via the conduit 4 to the hydraulic motor 2, and the changeover valves 33 and 34 connect the conduits 3 and 4 with the ports 15 or 14 of the control valve 10. The operation corresponds in principle to the above-described operation, however the piston of the hydraulic motor 2 moves in another direction and the lowering speed brake valve **7*a*** acts as a piston manometer.

Figure 3:
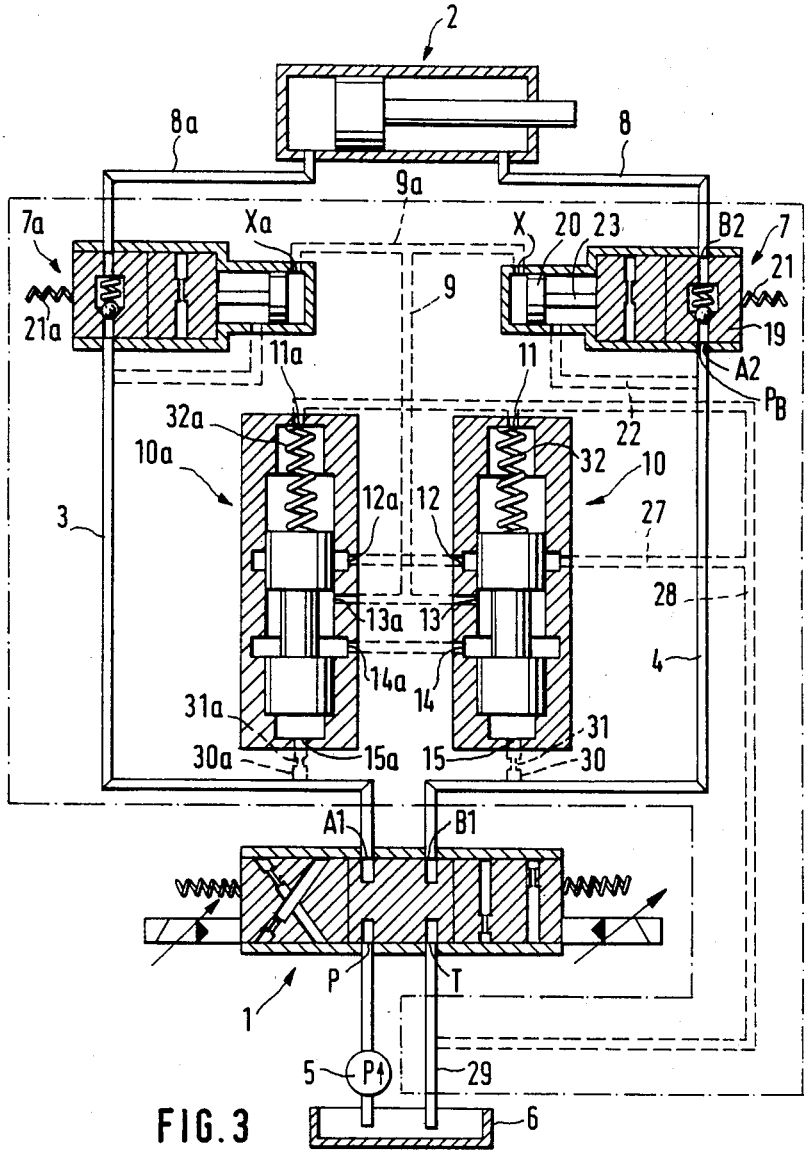
FIG. 3 is a view substantially corresponding to the views of FIGS. 1 and 2, but showing the arrangement for controlling the hydraulic motor in accordance with a further embodiment of the invention.

In the arrangement in accordance with the embodiment shown in FIG. 3, also two lowering speed brake valves 7 and **7*a* are used as in the embodiment of FIG. 2. Since here a second control valve 10*a* corresponding to the first control valve 10 is available, the changeover valves 33 and 34 are dispensed with. The ports 11, 12, 13 and 15 of the first control valve 10 are connected, as in the first embodiment, with the conduits 28, 27, 9 and 4. The port 15*a* of the control valve 10*a* is connected via a conduit 30*a* which is advantageously provided with an adjustable throttling point 31*a*, with the conduit 3. The ports 11 and 11*a*, 12 and 12*a*, 13 and 13*a*, 14 and 14*a* of both control valves 10 and 10*a*** are connected with one another.

The operation of the arrangement in accordance with the third embodiment in accordance with FIG. 3 corresponds to the operation of the arrangement in accordance with the second embodiment. In the first embodiment, however, because of the utilization of two control valves 10 and **10*a***, it is possible to select differently the nominal value of the pressure differential between the ports B1 and P at the one side, and between the ports A1 and T at the other side.

It will be understood that each of the elements described above, or two or more together, may also find a useful application in other types of constructions differing from the types described above.

While the invention has been illustrated and described as embodied in an arrangement for controlling a hydraulic motor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the present invention.

What is claimed as new and desired to be protected by Letters Patent is set forth in the appended claims.

What is claimed is:

1. An arrangement for controlling a hydraulic motor having interchangeable supply and discharge sides, comprising a throttling direction valve having in a working position thereof a supply side and a discharge side and an inlet port and an outlet port at each of said sides; said outlet port of the supply side of said directional valve being connected to a supply side of the hydraulic motor; a speed lowering brake valve controlling the discharge side of the hydraulic motor and having a control piston with a control side and a port connected with the inlet port of the discharge side of said directional valve; a control valve arrangement connected between said control side of said control piston and the supply side of the hydraulic motor and having end sides with end side ports, said control valve having a control slider which selectively connects said control side of said control piston with the supply side of the hydraulic motor and disconnects said control side of said control piston from the latter, one of said end side ports being constantly connected with said port of the speed lowering brake valve for controlling the discharge side of the hydraulic motor prior to said directional valve and the other end side port being constantly connected with the outlet port of the discharge side of said directional control valve for controlling the connection of said control side of said control piston of the speed lowering brake valve with the discharge side of said hydraulic motor, said control valve also having a control spring acting upon said control slider in a direction corresponding to a direction in which a pressure medium acts upon the discharge side of the hydraulic motor after said directional valve.

2. An arrangement for controlling a hydraulic motor as defined in claim 1; and further comprising a throttling location provided between the discharge side of the hydraulic motor prior to said directional valve and the end side port connected with said directional valve.

3. An arrangement for controlling a hydraulic motor as defined in claim 1; and further comprising a second such speed lowering brake valve controlling the supply side of the hydraulic motor and also having a control piston with a control side, the control sides of said speed lowering brake valves being connected with one another.

4. An arrangement for controlling a hydraulic motor as defined in claim 3; and further comprising two conduits connected with the sides of the hydraulic motor, and two changeover valves each provided in a respective one of said conduits prior to a respective one of said speed lowering brake valves, one of said changeover valves connecting the end side of said control slider with the discharge side of the hydraulic motor, whereas the other changeover valve connects said control side of said control piston selectively with the supply side of the hydraulic motor.

5. An arrangement for controlling a hydraulic motor as defined in claim 3; and further comprising a second such valve having such a slider, such end sides with end side ports and such a spring, each of said control valves having a plurality of further ports, the further ports of said control valves at a side facing away from said springs being connected with one another, each of said end side ports of said control valves at a side facing away from said springs being connected with a respective one of ports of said directional valve, whereas said ports of said directional valve are connected with the hydraulic motor.

6. An arrangement for controlling a hydraulic motor as defined in claim 1, wherein said directional valve is formed as an electrohydraulic proportional valve.

7. An arrangement for controlling a hydraulic motor as defined in claim 1 wherein said control valve includes means for establishing communication between said control side of said control piston of the speed lowering brake valve and the discharge side of said hydraulic motor only when said control side of said control piston is disconnected from said supply side of the hydraulic motor.

* * * * *

UNITED STATES PATENT AND TRADEMARK OFFICE

CERTIFICATE OF CORRECTION

PATENT NO. 4 531 449

DATED July 30,1985

INVENTOR(S) : Werner Reith

It is certified that error appears in the above—identified patent and that said Letters Patent is hereby corrected as shown below:

In column 7, line 4, the word "direction" should be -- directional--

Signed and Sealed this

*Twenty-eighth* Day of *January 1986*

[SEAL]

*Attest:*

DONALD J. QUIGG

*Attesting Officer*

*Commissioner of Patents and Trademarks*